US005881705A

United States Patent [19]

Howell et al.

[11] Patent Number: 5,881,705

[45] Date of Patent: Mar. 16, 1999

[54] COMPOUND BOW CABLE TENSION ADJUSTER

[75] Inventors: James B. Howell, Newberg, Oreg.; Michael W. Derus, Canandaigua, N.Y.

[73] Assignee: Golden Eagle Industries, LLC., Odessa, Fla.

[21] Appl. No.: 846,090

[22] Filed: May 1, 1997

Related U.S. Application Data

[60] Provisional application No. 60/028,258 Oct. 8, 1996.

[51] Int. Cl.[6] ..... F41B 5/10

[52] U.S. Cl. ..... 124/25.6; 124/900

[58] Field of Search ..... 124/25.6, 900

[56] References Cited

U.S. PATENT DOCUMENTS

| | | | |
|---|---|---|---|
| 4,337,749 | 7/1982 | Barna | 124/25.6 |
| 4,440,142 | 4/1984 | Simonds . | |
| 4,748,962 | 6/1988 | Larson . | |
| 4,770,154 | 9/1988 | Cook et al. . | |
| 4,774,927 | 10/1988 | Larson . | |
| 4,781,167 | 11/1988 | Martin . | |
| 4,838,236 | 6/1989 | Kudlacek . | |
| 4,926,832 | 5/1990 | Darlington | 124/25.6 |
| 4,967,721 | 11/1990 | Larson | 124/25.6 |
| 4,986,250 | 1/1991 | Darlington | 124/25.6 |
| 4,995,373 | 2/1991 | Mussack | 124/25.6 |
| 5,054,462 | 10/1991 | Larson | 124/25.6 |
| 5,301,651 | 4/1994 | LaBorde et al. | 124/25.6 |
| 5,381,777 | 1/1995 | Mitchell | 124/25.6 |
| 5,390,655 | 2/1995 | Mitchell et al. | 124/25.6 |
| 5,678,529 | 10/1997 | Larson | 124/25.6 |

*Primary Examiner*—John A. Ricci

*Attorney, Agent, or Firm*—Harris Beach & Wilcox, LLP.

[57] ABSTRACT

Apparatus for adjusting the angular position of the pulleys in a compound bow is mounted on each of the pulleys, not between the pulleys. The apparatus consists of either rotatable or slidable elements which are mounted on the pulleys. The tension cables contact these elements. The elements are designed such that movement of the elements moves the tension cables and causes changes in tension in the tension cables. This causes rotation of the pulleys, thus changing the angular position of the pulleys. The rotatable elements consist of either eccentrically mounted or shaped cams. The tension cables extend around the cams and are anchored to the pulleys. The rotation of the cams causes changes in tension in the tension cables, thus changing the angular position of the pulleys. The slidable elements consist of either a set screw or a sliding plate. In the case of a set screw, one end of the set screw contacts the tension cable and the tension cable is anchored to the pulley. Movement of the set screw changes tension in the tension cable, thus changing the angular position of the pulley. Alternatively, a tension plate is slidably attached to each pulley and is moved toward or away from a fixed plate by rotation of a thumb screw. The tension cables extend around the tension plates and are anchored to the pulleys. Movement of the tension plates changes the angular positions of the pulleys.

6 Claims, 6 Drawing Sheets

COMPOUND BOW CABLE TENSION ADJUSTER

CROSS REFERENCE TO RELATED APPLICATION

Reference is made to and priority claimed from U.S. Provisional Application Ser. No. 60/028,258 filed Oct. 8, 1996, entitled "COMPOUND BOW CABLE TENSION ADJUSTER".

BACKGROUND OF THE INVENTION

1. Field of the Invention

This invention relates generally to archery bows and more particularly, to improved means for adjusting the angular position or timing of the pulleys in compound bows.

2. Discussion of the Related Art

Compound archery bows have become increasingly popular for hunting and target shooting in recent years. These bows use tension cables which extend over eccentric pulleys rotatably mounted to the bow limbs to provide a mechanical advantage during the drawback and release of a bowstring.

The compound bow includes a bowstring for reception of the arrow. A pair of tension cable portions are connected to the ends of the bow and extend over the eccentrically mounted pulleys. The tension cables typically cross one another between the limbs and attach to the bow limb opposite the pulley over which the respective tension cable extends. As the bowstring is being drawn, the draw weight or force applied to the bow increases to a maximum draw weight and reduces to a lower draw weight at the full draw position due to the eccentric mounting of the pulleys. Accordingly, when the bowstring is in the fully drawn position, maximum potential energy is stored in the bow while the force required to maintain the bowstring in the fully drawn position is less than the maximum draw weight of the bow. In other words, maximum energy is stored in the limbs without requiring maximum force to be applied to the bowstring to hold it at the fully drawn position. This permits the archer to maintain aim on his target prior to release for a longer time and without undue strain for producing a better shot.

The shape of the pulleys determines the draw length of the bowstring. Much inventive energy has been devoted to devices which allow an archer to change the draw length of the bowstring. U.S. Pat. No. 4,774,927 to Larson discloses a pulley having a rotatable member attached thereto which, when rotated, allows for the archer to select one of several draw lengths. This device, however, does not affect the angular position of the pulleys (also referred to as the timing of the pulleys) relative to one another. Due to variations in manufacturing and assembly, the tension cables are not always of identical or optimal length. As a result, the pulleys to which they are attached are either advanced or retarded relative to each other. The solution to this problem is to change the effective cable length of one or both cables. This adjusts the angular positions of the pulleys either advancing or retarding them so that the upper and lower pulleys rotate in unison, reaching peak draw height and let-off portions of the pulleys simultaneously. Many devices have been developed for adjusting the angular position or timing of the pulleys of the bow. All of these methods include devices mounted on the tension cables, between the ends of the limbs. For example one method secures the inside cables to the bow limbs by means of a yoke member which in turn is secured by a yoke cable to the axle upon which the respective eccentric pulley is rotatably mounted.

One prior art patent, U.S. Pat. No. 4,440,142 to Simonds, discloses a yoke cable connected at both its ends to a pulley axle which rotatably supports an eccentrically mounted pulley. The cable extends about a perimetric edge portion of a disk-like yoke for securing the disk relative to the axle. A plurality of attachment grooves are formed in the disk which are disposed at varying distances from the disk center. An end of the tension cable extends through the center of the disk and is received by any one of these attachment portions, and is looped back to itself and fixedly secured by a clasp or sleeve-like member. Such an anchoring device enables the tension in the tension cable to be adjusted by changing which of the attachment portions in which the loop in the tension cable is received.

Such a yoke structure is not without drawbacks. For example, to change the tension cable to a different attachment portion in the disk, tension in the cable must be released to enable the cable to be removed from the existing attachment portion. Additionally, each of the attachment portions is set at some fixed distance from the center which enables only a small number of specific finite tension adjustments to be made with a given disk. Also, by placing an anchoring device on the cable (between the pulleys) the weight of the anchoring device causes oscillation of the cables during movement of the bowstring. This can decrease the accuracy of the bow.

With the instant arrangement, one can change the angular relationship of one pulley with respect to the other or one can change the angular position of both pulleys in an incremental manner. Also, because the adjustment device is mounted on the pulleys, instead of the cables, oscillation of the bowstring is eliminated.

SUMMARY OF THE INVENTION

The present invention provides an apparatus designed to adjust the angular positions of the pulleys in a bow which overcomes the deficiencies of such apparatus of the past. It is desirable to have the pulleys timed such that the angular positions of the pulleys match one another. In other words, as the bowstring is drawn (or released), the pulleys are in the same angular orientation with respect to one another. The present invention allows for precise adjustment of the positions of the pulleys with respect to one another. Also, with the present invention, because adjustment of the tension in the tension cables is made through apparatus mounted on the pulleys, the problem of oscillation of the bowstring associated with tension adjusting apparatus of the past is avoided.

The present invention is adapted to be used in connection with a compound bow having a handle and a pair of limbs extending from the handle. A pair of pulleys are attached to the limbs, as is known in the art. A first tension cable runs between one of the pulleys and the limb at the opposite end. A second tension cable runs between the other pulley and the limb at the opposite end. Other means for attaching the tension cables to the bows are possible and are known in the art. The particular arrangement described herein is not intended to limit the present invention to that arrangement. A bowstring extends between the pulleys. Means for adjusting the angular position of the pulleys are provided. Unlike the compound bows of the prior art, the means for adjusting the angular position of the pulleys is mounted on each of the pulleys and not between the pulleys. The means to adjust the angular position of the pulleys could be either rotatable elements or slidable elements which are mounted on the pulleys. The tension cables contact these elements. The elements are designed such that movement of the elements moves the tension cables and causes the tension in the tension cables to change. A change in the tension in the tension cable will cause rotation of the pulleys, thus changing the angular position of the pulleys.

The rotatable elements consist of either eccentrically mounted or shaped cams. The tension cables extend around the cams and are anchored to the pulleys. The rotation of the cams causes the tension in the tension cables to change, thus changing the angular position of the pulleys.

The slidable elements consist of either a set screw or a sliding plate. In the case of a set screw, one end of the set screw contacts the tension cable and the tension cable is anchored to the pulley. Movement of the set screw, by turning the set screw, changes the tension in the tension cable, thus changing the angular position of the pulley. The sliding plate works in a similar manner. A fixed plate is rigidly attached to each pulley. A thumb screw is threadably and rotatably attached to each fixed plate. A tension plate is slidably attached to each pulley and is moved toward or away from the fixed plate by rotation of the thumb screw. The tension cables extend around the tension plates and are anchored to the pulleys. Movement of the tension plates changes the tension in the tension cables, thus changing the angular positions of the pulleys.

BRIEF DESCRIPTION OF THE DRAWINGS

For a better understanding of the present invention, reference will be made to the following detailed description of the invention which is to be read in conjunction with the accompanying drawings, wherein.

DESCRIPTION OF THE INVENTION

Figure 1:
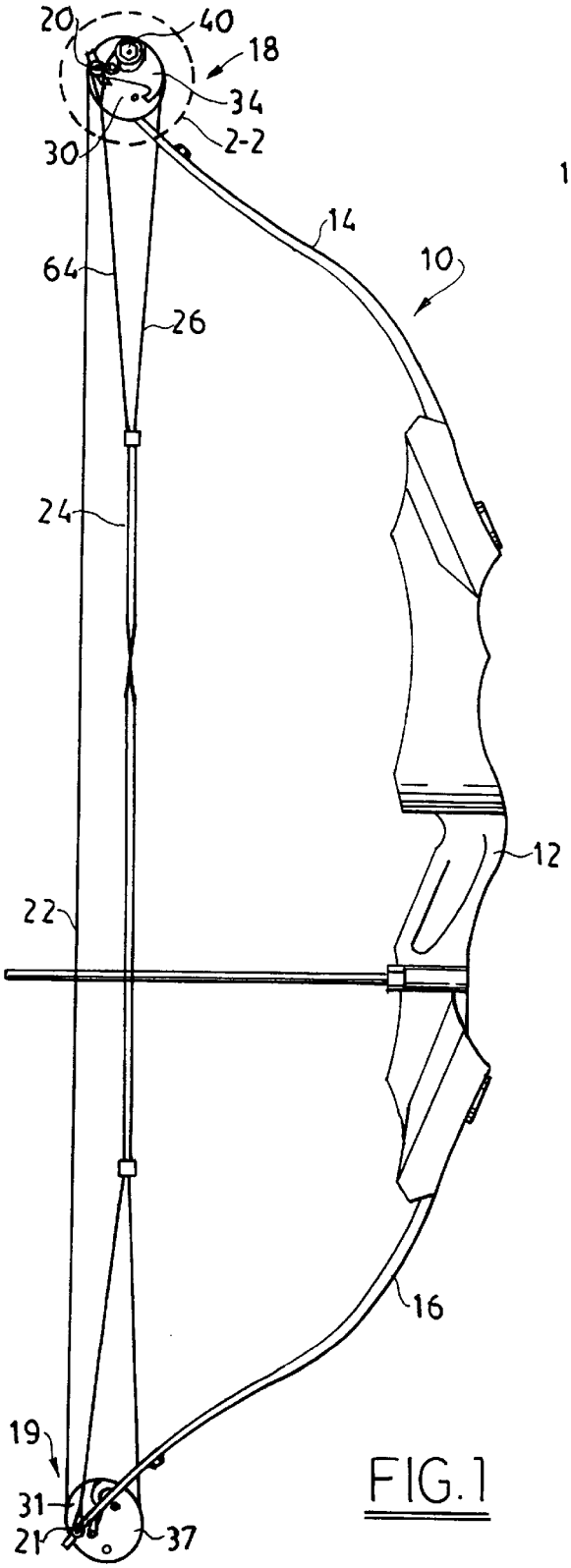
FIG. 1 is a front view of a compound bow including the present invention.

Referring now to the drawings, there are illustrated pulleys of compound bows having cam mounted cable tension adjusters. FIG. 1 illustrates a compound bow 10 having a center handle portion 12 which supports an upper limb 14 and a lower limb 16. Eccentric pulley assemblies 18 and 19 are rotatably mounted adjacent the outermost ends of the upper and lower limbs 14, 16 by pulley axles 20 and 21. The pulley assembly 18 includes a first pulley 30 and a second pulley 34 mounted on the first pulley 30, as is known in the art. The pulley assembly 19 includes a first pulley 31 and a second pulley 37 mounted on the first pulley 31. The bow 10 includes a bowstring 22.

For each embodiment of the present invention described below, the pulley assembly 19 preferably has a tensioner attached thereto which is identical to the tensioner attached to the pulley assembly 18. However, the bow 10 could have a tensioner of one embodiment attached to pulley assembly 18 and a tensioner of another embodiment attached to pulley assembly 19. For the purpose of simplicity, only the tensioner associated with pulley assembly 18 is described below.

Referring to FIGS. 2–5, the pulley assembly 18 is illustrated. The bowstring 22 engages a groove 23 in the perimeter of the pulley 30. The bowstring 22 is received by channel 60 (FIG. 4) and is anchored to pulley 30 by pin 62. A pair of tension cables 24 and 26 are provided, as is known in the art. The tension cable 24 splits into two segments, only one of which 64 is illustrated, which are anchored on the limb 14 at the pulley axle 20. The tension cable 26 engages a groove 39 (FIG. 5) in pulley 34, engages a groove 41 in cam 40 and is anchored by pin 50. The opposite ends of tension cables 24 and 26 are anchored to pulley assembly 19 in a similar manner, however the opposite end of tension cable 24 is pinned to the pulley assembly 19 and the opposite end of cable 26 splits and is anchored to the limb 16.

Figure 2:
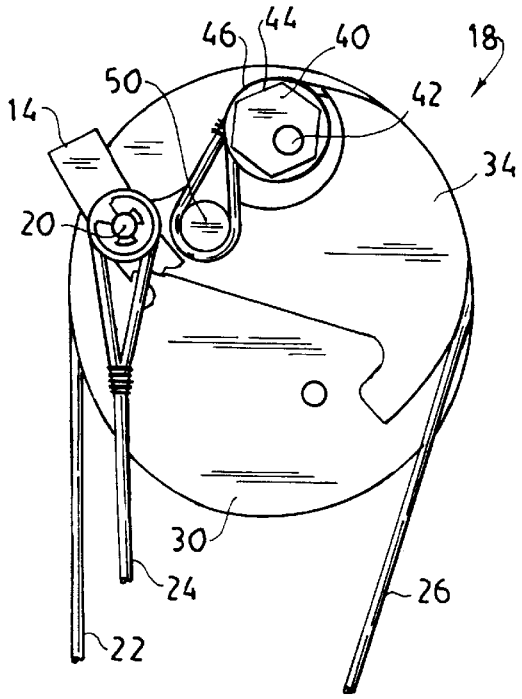
FIG. 2 is an enlarged view of area 2 in FIG. 1.
Figure 4:
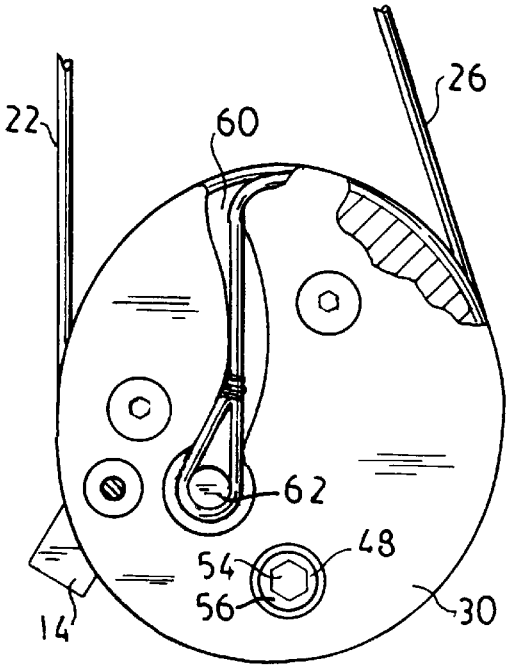
FIG. 4 is a rear view of a pulley including the embodiment of the present invention shown in FIG. 3.
Figure 3:
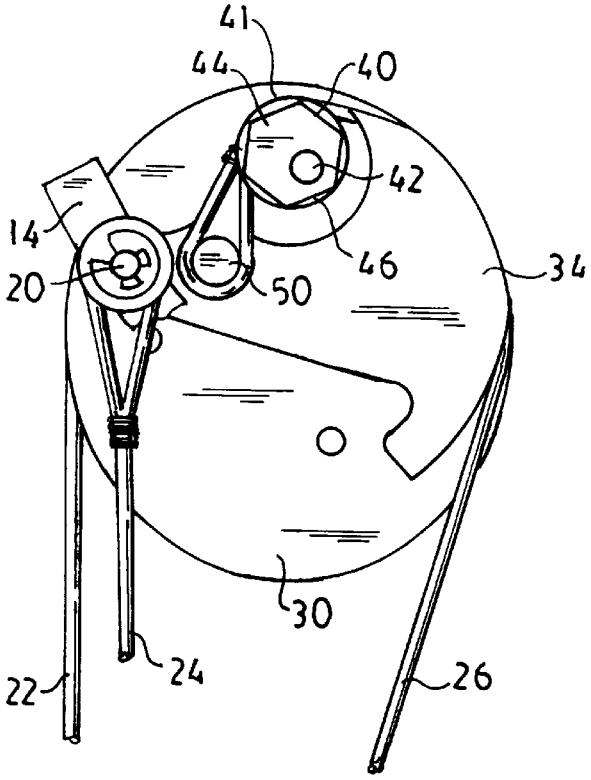
FIG. 3 is a front view of a pulley including one embodiment of the present invention.
Figure 5:
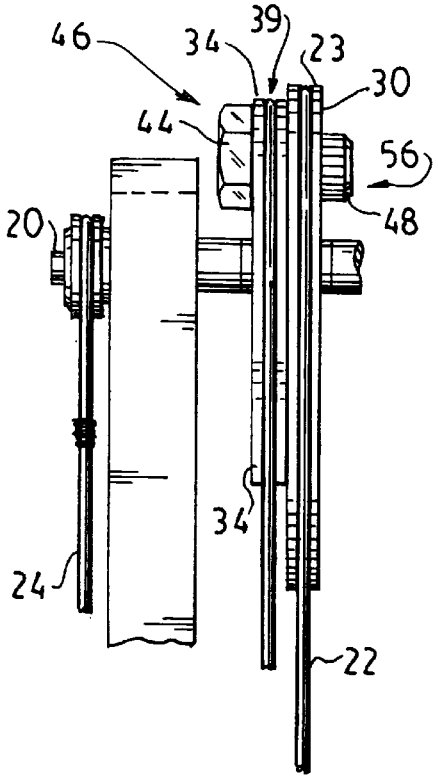
FIG. 5 is an end view of a pulley including the embodiment of the present invention shown in FIG. 3.

Cam 40 is rotatably mounted to pulley assembly 18 by a pin 42, offset from the center of cam 40. Cam 40 includes a hex nut 44 on a first side 46 and a set screw 48 with an allen socket 54 on a second side 56. The set screw 48 is threadably attached to the pulley assembly 18 such that by inserting an allen wrench (not shown) into the allen socket 54, the set screw 48 can be tightened or loosened. When the set screw 48 is loosened, the cam 40 can be rotated about pin 42 through use of a wrench (not shown) which engages hex nut 44. FIG. 2 shows the cam 40 in a first position and FIG. 3 shows the cam 40 rotated to a second position. In FIG. 3, the tension in the tension cable 26 has been increased. The rotation of cam 40 alters the tension of the tension cable and, thus, the angular position of the pulleys. By altering the angular position of the pulleys, the timing of the pulley assemblies 18 and 19 is affected. It is desirable to have pulley assemblies 18 and 19 synchronized so that the bowstring 22 passes over the same portion of each of the pulley assemblies 18 and 19 at the same time throughout the drawing of the bowstring 22 and following release of the bowstring 22. This ensures that the force of the bowstring is transmitted to the arrow along the axis of the arrow.

Figure 7:
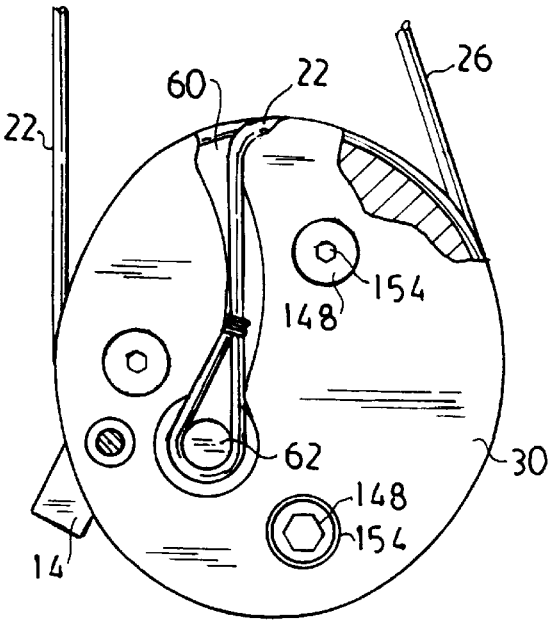
FIG. 7 is a rear view of a pulley including the embodiment of the present invention shown in FIG. 6.
Figure 6:
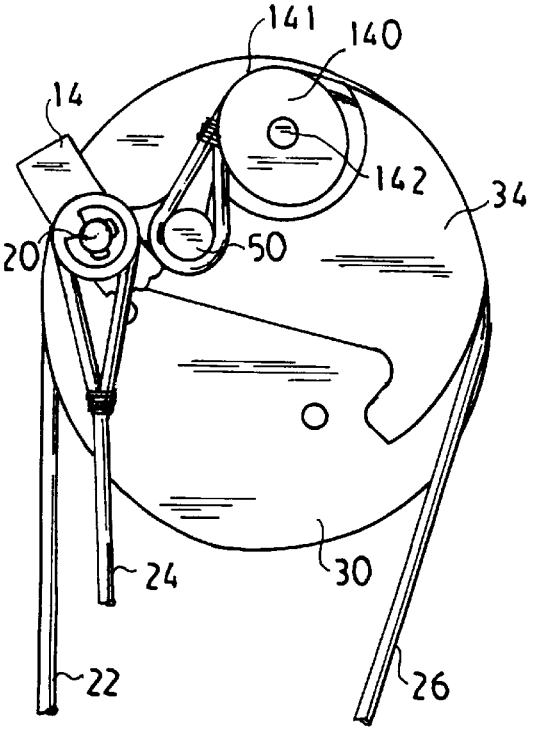
FIG. 6 is a front view of a pulley including a second embodiment of the present invention.
Figure 8:
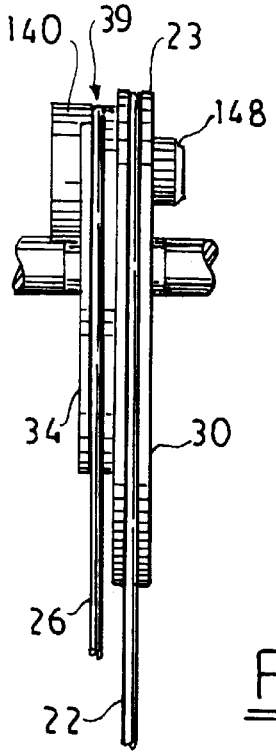
FIG. 8 is an end view of a pulley including the embodiment of the present invention shown in FIG. 6.

In a second embodiment, as illustrated in FIGS. 6–8, a cam 140 is provided which is rotatably mounted to pulley 30 by pin 142. The pin 142 is in the center of the cam 140; however, the cam 140 is elliptical in shape. The tension cable 26 rests in a groove 141 in cam 140. Rotation of the cam 140 causes the tension in tension cable 26 to change, thus adjusting the angular position of pulley 30. The cam 140 also includes a set screw 148 and allen socket 154 similar to those attached to cam 40. Loosening the set screw 148 will allow for adjustment of the position of the cam 140.

Figure 10:
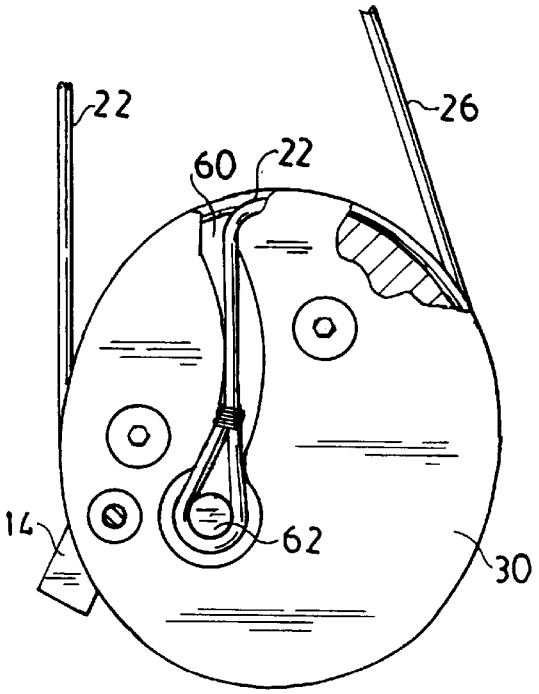
FIG. 10 is a rear view of a pulley including the embodiment of the present invention shown in FIG. 9.
Figure 9:
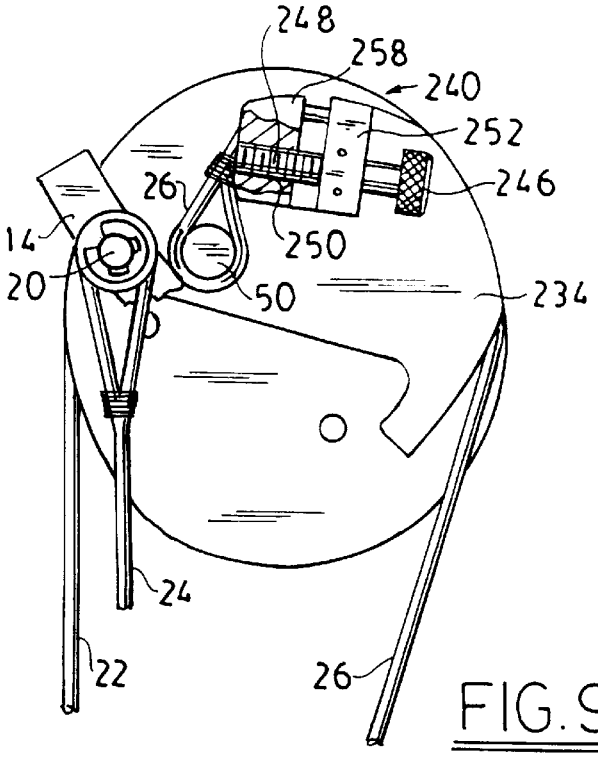
FIG. 9 is a front view of a pulley including a third embodiment of the present invention.
Figure 11:
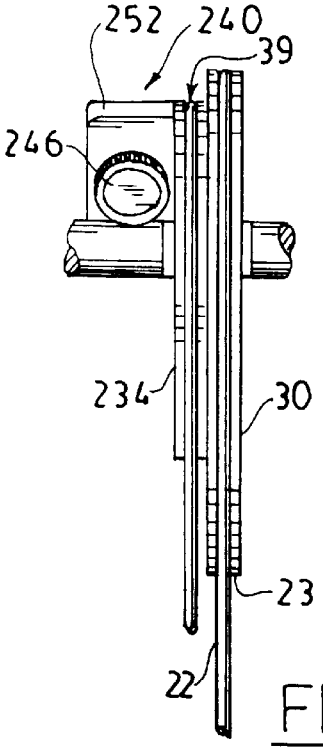
FIG. 11 is an end view of a pulley including the embodiment of the present invention shown in FIG. 9.

In a third embodiment, as illustrated in FIGS. 9–11, a tensioner 240 is mounted on pulley 234 in place of cams 40 or 140. The tensioner 240 includes a thumbscrew 246 threadably and rotatably mounted to a fixed plate 252. The thumbscrew 246 has threads 248 which engage a threaded bore 250 in a tension plate 258. The tension plate 258 is slidably mounted on pulley 234 and is moved by rotation of thumbscrew 246. Rotation of the thumbscrew 246 moves tension plate 258 either toward or away from the fixed plate 252. When the tension plate 258 moves away from the fixed plate 252, the tension in tension cable 26 is increased. When the tension plate 258 moves toward the fixed plate 252, the tension in the tension cable 26 is decreased.

Figure 13:
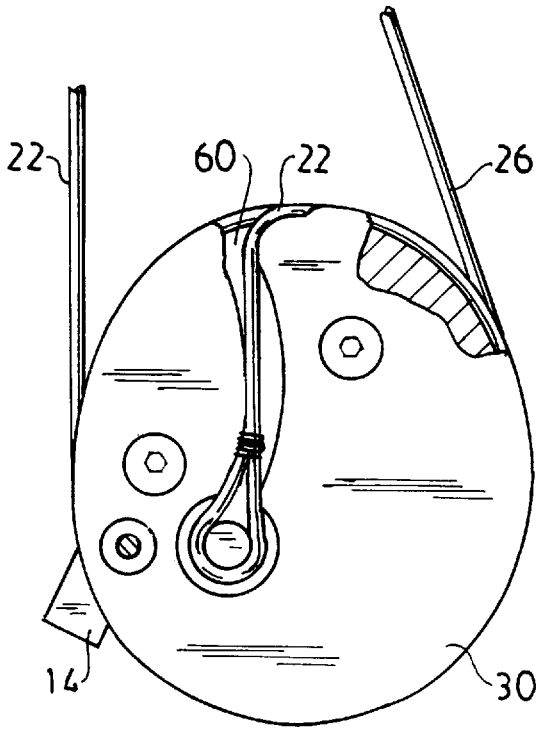
FIG. 13 is a rear view of a pulley including the embodiment of the present invention shown in FIG. 12.
Figure 14:
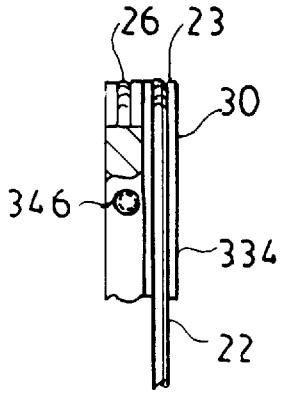
FIG. 14 is a partial cross-sectional end view of a pulley including the embodiment of the present invention shown in FIG. 12 taken along the line 14—14 in FIG. 12.
Figure 12:
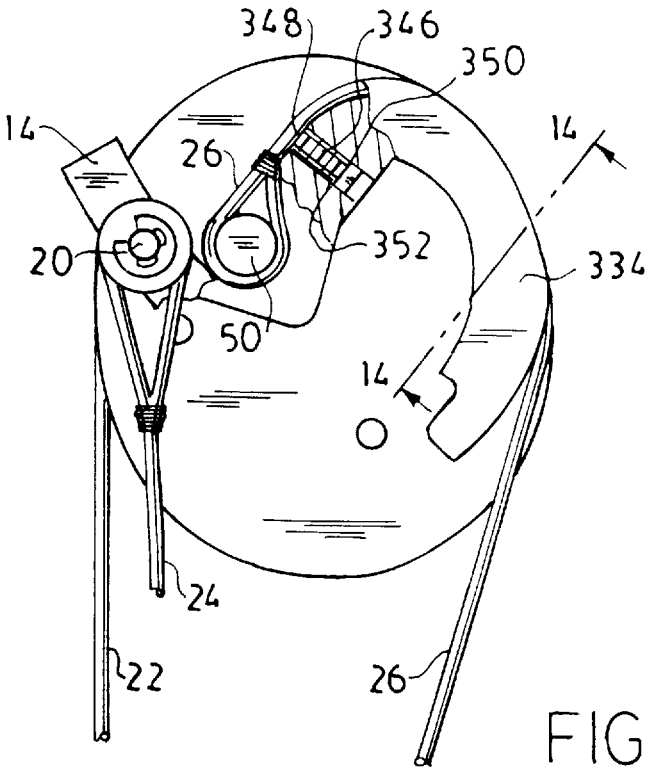
FIG. 12 is a front view of a pulley including a fourth embodiment of the present invention.

In a fourth embodiment, as illustrated in FIGS. 12–14, the thumbscrew 246 is replaced with a set screw 346. The set screw 346 is threadably attached to pulley 334 by threads 350 which engage a threaded bore 352. The set screw 346 has an engagement end 348 which engages tension cable 26. By moving set screw 346 back and forth, the tension in tension cable 26 is changed.

Figure 16:
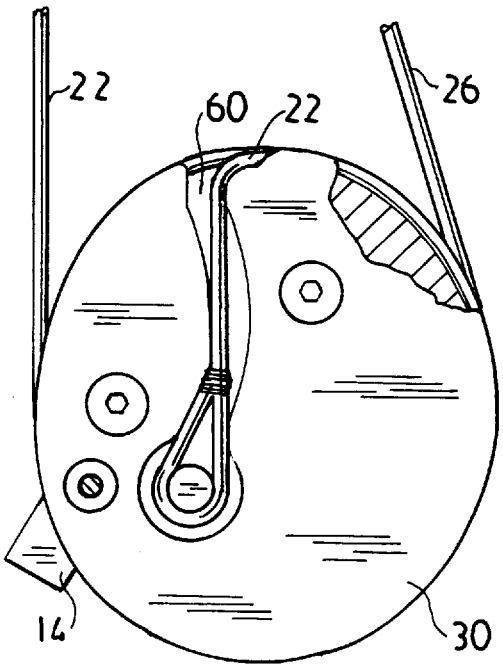
FIG. 16 is a rear view of a pulley including the embodiment of the present invention shown in FIG. 15.
Figure 15:
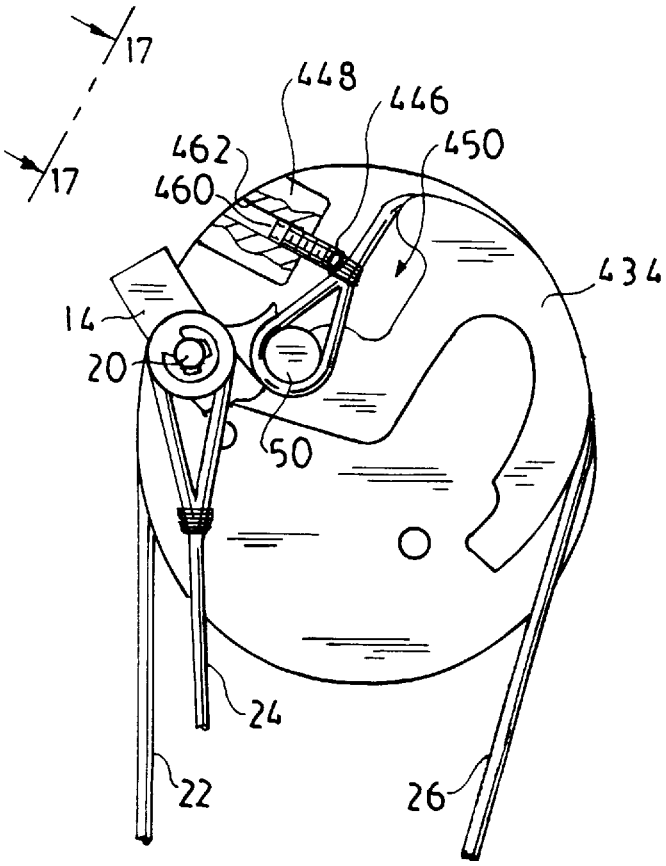
FIG. 15 is a front view of a pulley including a fifth embodiment of the present invention.
Figure 17:
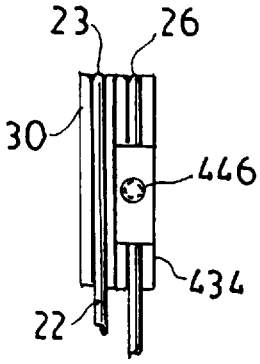
FIG. 17 is an end view of a pulley including the embodiment of the present invention shown in FIG. 15 in the direction of line 17—17 in FIG. 15.

In a fifth embodiment, as illustrated in FIGS. 15–17, a set screw 446 is mounted on pulley 30 and threadably attached to mounting plate 448 by threads 460 which engage a threaded bore 462. The pulley 434 has a notch 450 therein. The set screw 446 moves toward and away from pulley 34, by rotation of the set screw 446. When the set screw 446 moves toward the notch 450, the tension in the tension cable 26 increases. When the set screw 446 moves away from the notch 450, the tension in the tension cable 26 decreases.

While this invention has been explained with reference to the structure disclosed herein, it is not confined to the details set forth and this invention is intended to cover any modifications and changes as may come within the scope of the following claims:

What is claimed is:

1. A compound bow comprising:

a handle;

first and second limbs extending from said handle;

a first pulley attached to said first limb;

a second pulley attached to said second limb;

a first tension cable having two ends, a first end fixed on said first pulley and a second end fixed on said second limb;

a second tension cable having two ends, a first end fixed on said second pulley and a second end fixed on said first limb;

a bowstring extending between said first and second pulleys;

means for synchronizing the angular position of said first and second pulleys relative to one another, said means for synchronizing the angular position of the pulleys mounted on each of the pulleys and adapted to change the tension in said tension cables.

2. The compound bow of claim 1 wherein said means for synchronizing the angular position of said pulleys is rotatably mounted on each of the pulleys.

3. The compound bow of claim 2 wherein said means for synchronizing the angular position of said pulleys includes a pair of cams, one of said pair of cams rotatably mounted on said first pulley, the other of said pair of cams rotatably mounted on said second pulley such that rotation of said cams moves said tension cables to change the tension in said tension cables.

4. The compound bow of claim 1 wherein said means for synchronizing the angular position of said pulleys is slidably mounted on each of the pulleys.

5. The compound bow of claim 4 wherein said means for synchronizing the angular position of said pulleys includes a fixed plate, a thumb screw and a tension plate mounted on each of said pulleys, said fixed plates rigidly attached to each of said pulleys, each of said tension plates slidably mounted on said pulleys, said thumb screws threadably attached to said fixed plates and adapted to move said tension plates toward and away from said fixed plates by rotation of said thumb screws, said tension cables passing over said tension plates moves said tension cables and such that movement of said tension plates changes the angular position of said pulleys.

6. The compound bow of claim 4 wherein said means for synchronizing the angular position of said pulleys includes a set screw rotatably mounted to each of said pulleys such that rotation of said set screws causes said set screws to move along the longitudinal axis of said set screws, said tension cables passing over one end of said set screws such that movement of said set screws moves said tension cables and changes the angular position of said pulleys.

* * * * *